US006010240A

United States Patent [19]

Schaefer et al.

[11] Patent Number: 6,010,240

[45] Date of Patent: Jan. 4, 2000

[54] CAPSULE HOLDER FOR ROTARY MIXING DEVICE

[75] Inventors: Olaf Schaefer, Germering; Werner Lissner, Starnberg, both of Germany

[73] Assignee: ESPE Dental AG, Seefeld, Germany

[21] Appl. No.: 09/061,909

[22] Filed: Apr. 17, 1998

[30] Foreign Application Priority Data

Apr. 18, 1997 [DE] Germany ..... 297 07 012 U

[51] Int. Cl.[7] ..... B01F 11/00

[52] U.S. Cl. ..... 366/209; 366/602

[58] Field of Search ..... 366/110, 111, 366/112, 114, 208–216, 219, 602

[56] References Cited

U.S. PATENT DOCUMENTS

| | | | |
|---|---|---|---|
| 1,489,024 | 4/1924 | Burnett | 366/209 |
| 1,490,214 | 4/1924 | Johnson | 366/209 |
| 2,759,712 | 8/1956 | Hvistendahl | 366/209 |
| 3,749,390 | 7/1973 | Schubert | 366/602 |
| 4,074,900 | 2/1978 | Drury | 366/602 |
| 4,890,931 | 1/1990 | Herold | 366/209 |
| 5,167,448 | 12/1992 | Herold et al. | 366/213 |
| 5,338,114 | 8/1994 | Steele | 366/602 |

*Primary Examiner*—Charles E. Cooley
*Attorney, Agent, or Firm*—Foley & Lardner

[57] ABSTRACT

A capsule holder for retaining a mixing capsule on a rotary mixing device includes a carrier plate 10, an actuator disk 11 rotatable relative to the plate, and two retaining arms 12, 13 for clamping the capsule from opposite sides, the retaining arms having driving pins 22 engaging spiral cam slots 26 of the actuator disk 11. By rotating the actuator disk 11, the retaining arms 12, 13 are moved away from, or toward, each other. The thus constituted gearing is self-locking in one direction of force transmission so that centrifugal forces exerted on the retaining arms 12, 13 during rotation cannot move the arms apart. On the other hand, the retaining arms 12, 13 are opened with little effort by rotating the actuator disk 11.

5 Claims, 1 Drawing Sheet

CAPSULE HOLDER FOR ROTARY MIXING DEVICE

BACKGROUND OF THE INVENTION

Rotary mixing devices, such as known from U.S. Pat. No. 5,167,448, are used for intensively mixing material components, specifically dental substances consisting of two or more components. In the known device, a capsule containing the substance is placed in a holder which is mounted on a rotary disk at an eccentric position with respect to the disk axis and so that the holder is rotatable about it own axis. The known mixing device is capable of performing both a mixing step proper, in which the capsule is moved back and forth due to its own rotation on the rotary disk, and a centrifuging step, in which the capsule itself does not rotate relative to the rotary disk and the substance is compressed in the direction of a dispensing piston provided within the capsule.

Conventional capsule holders for dental mixing devices are fork-shaped and consist of two leaf springs or of a rigid member and a resilient member, between which the capsule is clamped. U.S. Pat. No. 4,890,931 discloses a capsule holder of this type, which comprises a carrier portion adapted to the coupled to a rotary part of the mixing device, and a pair of retaining members movable relatively to each other along a capsule clamping direction and disposed on said carrier portion for engaging a capsule from two opposite sides along said clamping direction.

The known mixing forks require a comparatively large amount of space, specifically in the direction perpendicular to the capsule axis (which is usually the axis along which the mixing movement takes place). Further, they are unsuited for the rotary mixing devices described above because they fail to retain the capsule with sufficient safety during the mixing and centrifuging steps, in which forces exerted on the capsule are not only in the clamping direction.

SUMMARY OF THE INVENTION

It is an object of the invention to provide a capsule holder which is easy to handle and capable of reliable retaining of the mixing capsule, thereby being specifically suited for rotary mixing devices.

To meet this object, the invention provides a capsule holder for a rotary mixing device, comprising a carrier portion adapted to the coupled to a rotary part of the mixing device, a pair of retaining members movable relatively to each other along a capsule clamping direction and disposed on the carrier portion for engaging a capsule from two opposite sides along the clamping direction, and an actuator member mounted on the carrier portion and being movable relative to the carrier portion and being in engagement with at least one of the retaining members through guide means which extends at an angle with respect to both the direction of movement of the actuator member and the clamping direction.

In the capsule holder of the invention, the capsule is clamped between the retaining members by means of a gearing rather than by spring force in such a manner that moving the capsule retaining member or members is readily possible by the actuator member, while the actuator member is substantially more difficult to move, if at all, by the retaining members .

The guide means preferably extends at an angle with respect to the clamping direction which is larger than the angle at which the guide means extends with respect to the direction of movement of the actuator member. This structure results in a self-locking type of gearing.

In a preferred embodiment, the actuator member is in engagement with both of the retaining members through the guide means. The retaining members thus move symmetrically so that the center of gravity of the capsule holder remains substantially constant irrespective of the size of the capsule.

In accordance with another embodiment, actuator member is resiliently biased toward a position in which it urges the retaining members toward each other. Thus, the capsule is clamped even without manual movement of the actuating member. Since the resilient force only has to move the easily movable actuating member without having to withstand any forces occurring during the mixing step, it may be correspondingly weak. Therefore, when a capsule is to be placed in the holder, a much smaller force has to be overcome that is the case in the known spring-loaded mixing forces.

In another preferred embodiment, the actuator member is mounted for rotation relative to the carrier portion and has a spiral cam arrangement, and the retaining member has a follower engaging the cam arrangement. This is of advantage because the center of gravity of the capsule holder does not change in response to the position of the actuating member.

The spiral cam arrangement may be so shaped that the retaining members are moved away from each other when the actuator member is rotated in a direction opposite to the rotational direction of the mixing device. With this structure, the clamping force exerted on the capsule by the retaining member is assisted by forces which occur when the mixing device rotates in the prescribed sense of rotation. In this case, the spring, which may be provided, has the only purpose of ensuring that the capsule is fixed when the rotation starts.

For the practical manipulation of the capsule holder, it is preferred that the cam arrangement extends through an angle substantially between 45° and 180°.

According to another embodiment of the invention, the carrier portion is formed as a disk having a guide slot for the retaining member, the slot being open at the periphery of the disk. This is useful to make the capsule holder easy to assemble.

Providing the disk with an outward sloping peripheral portion within the area of the guide slot ensures that the retaining members, when completely moved apart, are somewhat tilted open so that the mixing capsule may be inserted and removed particular easily.

DETAILED DESCRIPTION OF PREFERRED EMBODIMENTS

Figure 1:
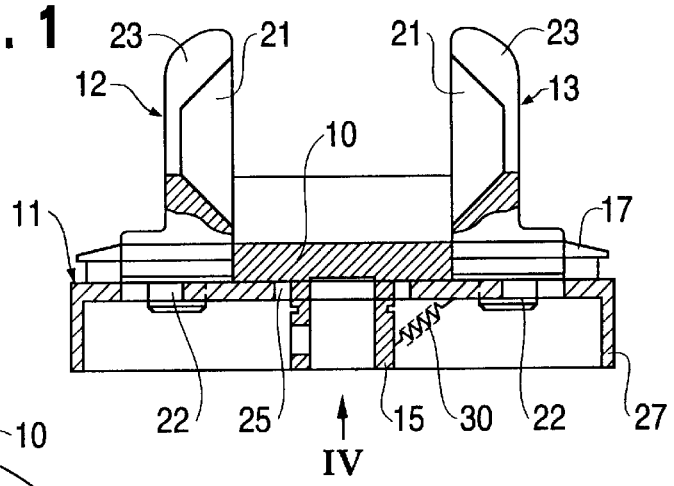
FIG. 1 is a sectional view of a capsule holder.

In accordance with FIG. 1, the capsule holder substantially consists of four components: a circular carrier plate 10, an actuator disk 11, and a pair of capsule retaining arms 12, 13.

The lower side of the carrier plate 10 is provided with a sleeve 15 for mounting on a shaft (not shown) which shaft may be eccentrically mounted on a rotating disk of a rotary mixing device. The mixing device may have the structure described in U.S. Pat. No. 5,167,448.

Figure 2:
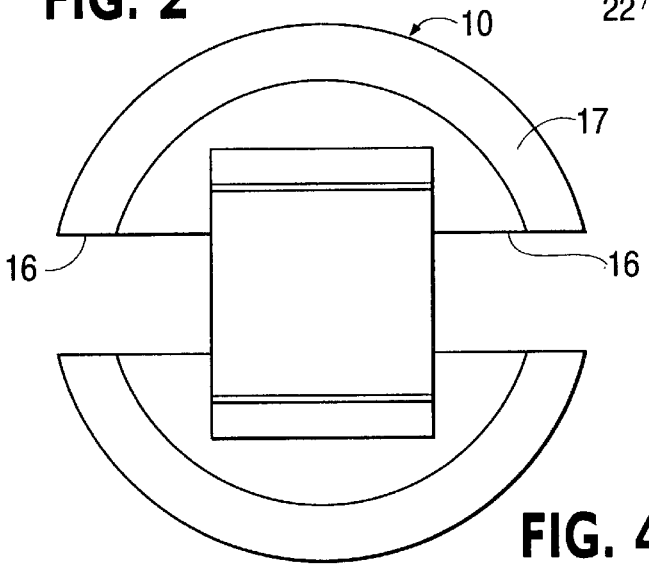
FIG. 2 is a plan view of a carrier disk of the capsule holder.

According to FIGS. 1 and 2, the carrier plate 10 has two guide slots 16 aligned along a common axis which intersects the axis of the carrier plate 10. The guide slots 16 commence at a distance from the center of the carrier plate 10 and are open at the periphery thereof. The spacing between the inner ends of the guide slots 16 depends on the length of the shortest capsule to be received by the retaining arms 12, 13. While the main area of the surface of the carrier plate 10 is planar, its peripheral portion 17 slopes outward.

Figure 3:
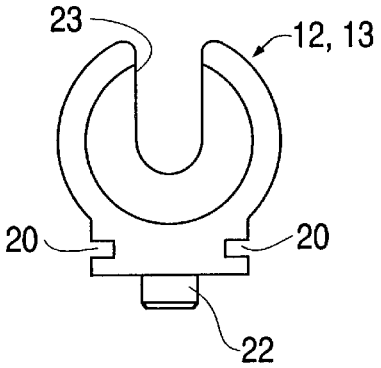
FIG. 3 is a side view of one of a pair of retaining arms of the capsule holder.

As shown in FIG. 3, the lower part of the retaining arms 12, 13 is provided with lateral grooves 20 which cooperate with lateral edges of the guide slots 16 provided in the carrier plate 10 to form a slide. The mutually facing sides of the retaining arms 12, 13 each have a recess 21 for receiving a respective end of a mixing capsule. A cylindrical driving pin 22 is formed on the lower side of each retaining arm 12, 13.

Figure 4:
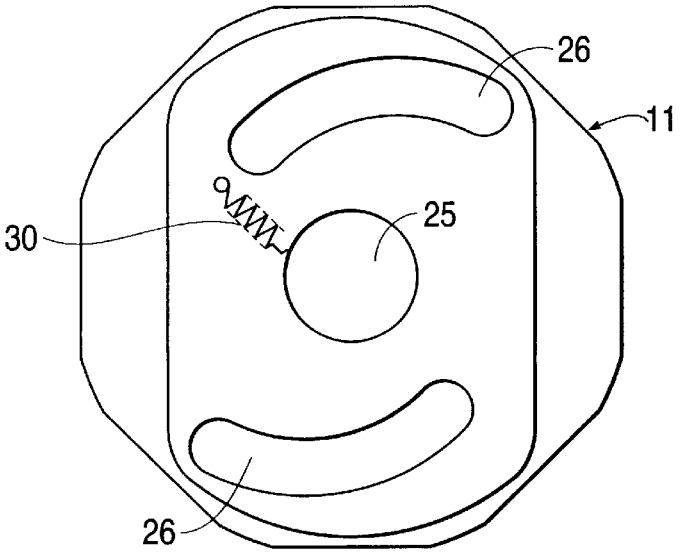
FIG. 4 is a bottom view of the capsule holder taken in the direction of the arrow IV in FIG. 1.

In accordance with FIGS. 1 and 4, the sleeve 15 of the carrier plate 10 extends through a central bore 25 provided in the actuator disk 11. The actuator disk 11 has a pair of spiral cam slots 26 arranged rotationally symmetrical and diametrically opposite each other, each extending though an arc between 45° and 180°. Each cam slot 26 is engaged by the driving pin 22 of the respective retaining arm 12, 13. A downward extending annular flange 27 integrally formed on the actuator disk 11 has a knurled outer surface for easy manipulation.

For inserting a mixing capsule, which is generally cylindrical with rounded ends, the capsule holder is opened by rotating the actuator disk 11 in the sense in which the driving pins 22 of the retaining arms 12, 13 engaging the cam slots 26 move away from the center of the actuator disk 11; in other words, the actuator disk 11 is rotated counter-clockwise in FIG. 4. In the position in which the retaining arms 12, 13 have their maximum spacing, they are in the sloping peripheral portion 17 of the carrier plate 10 and may be slightly tilted apart so that the capsule can be inserted more easily.

The capsule is placed between the two recesses 21 of the retaining arms 12, 13. A dispensing nozzle, which may be provided at one end of the capsule, is placed in the slot 23 provided in one of the retaining arms 12, 13. For more comfortable handling and for reasons of symmetry, both retaining arms 12, 13 have such a slot 23, as shown in FIG. 1.

Rotation of the actuator disk 11 in the opposite sense will move the retaining arms 12, 13 toward each other so that the inserted capsule is engaged and fixed in the recesses 21. This movement is assisted by a spring 30 (shown in FIGS. 1 and 4) which connects the actuator disk 11 with the sleeve 15 of the carrier plate 10.

The spirally curved cam slots 26 extend under such an angle with respect to the radial direction that the retaining arms 12, 13 are readily moved by rotating the actuator disk 11. However, if a force exerted on the retaining arms 12, 13 along the direction of the guide slots 16 in the carrier plate 10, frictional forces acting on the actuator disk will prevent any movement of the arms. The so formed gearing is thus self-locking in one direction of force transmission.

According to FIG. 4, the spiral cam slots 26 are so shaped that their spacing from the center of rotation of the actuator disk 11 increases in the clockwise direction. Depending upon the sense of rotation of the rotary disk of the mixing device, this shape is so selected that the rotation produces forces on the capsule holder which seek to rotate the actuator disk 11 in a sense in which the retaining arms 12, 13 are moved toward each other. In this way, the rotation of the mixing device assists the retaining forces exerted on the capsule.

In a modification (not shown in the drawings) the actuator disk 11 is fixed to a shaft mounted on the rotary disk of the mixing device whereas the carrier plate 10 is rotatable relative to the shaft. In this case, the retaining arms 12, 13 can be moved toward and away from each other by rotating the carrier plate 10, the outer periphery of which may be milled or knurled for easy manipulation.

We claim:

1. A capsule holder for a rotary mixing device, the capsule holder comprising:

a carrier portion adapted to be coupled to a rotary part of the mixing device, a pair of retaining members movable relatively to each other along a capsule clamping direction and disposed on said carrier portion for engaging a capsule from two opposite sides along said clamping direction, and an actuator member mounted on said carrier portion, said actuator member being movable relative to said carrier portion and being in engagement with at least one of said retaining members through guide means which extends at an angle with respect to both the direction of movement of said actuator member and said clamping direction, wherein said actuator member is mounted for rotation relative to said carrier portion and has a spiral cam arrangement, and said retaining member has a follower engaging said cam arrangement.

2. The capsule holder of claim 1, wherein said spiral cam arrangement is so shaped that said retaining members are moved away from each other when said actuator member is rotated in a direction opposite to the rotational direction of the mixing device.

3. The capsule holder of claim 1, wherein said cam arrangement extends through an angle substantially between 45° and 180°.

4. A capsule holder for a rotary mixing device, the capsule holder comprising:

a carrier portion adapted to be coupled to a rotary part of the mixing device, a pair of retaining members movable relatively to each other along a capsule clamping direction and disposed on said carrier portion for engaging a capsule from two opposite sides along said clamping direction, and an actuator member mounted on said carrier portion, said actuator member being movable relative to said carrier portion and being in engagement with at least one of said retaining members through guide means which extends at an angle with respect to both the direction of movement of said actuator member and said clamping direction, wherein said carrier portion is formed as a disk having a guide slot for each of said retaining members, said slot being open at the periphery of said disk.

5. The capsule holder of claim 4, wherein said disk has an outward sloping peripheral portion within the area of said guide slot.

* * * * *